United States Patent [19]

Grasso

[11] Patent Number: 4,486,648

[45] Date of Patent: Dec. 4, 1984

[54] ENERGY REGULATOR FOR A HOUSEHOLD HEATING APPLIANCE FOR PRODUCING VARIABLE SPEED INITIAL HEATING

[75] Inventor: Alfie L. Grasso, Bewdley, England

[73] Assignee: Micropore International Limited, Droitwich, England

[21] Appl. No.: 405,357

[22] Filed: Aug. 5, 1982

[30] Foreign Application Priority Data

Aug. 6, 1981 [GB] United Kingdom ..... 8124088

[51] Int. Cl.[3] ..... H05B 1/02

[52] U.S. Cl. ..... 219/501; 219/492; 219/493; 219/448; 219/453; 219/510; 236/46 D

[58] Field of Search ..... 219/490, 492, 493, 494, 219/501, 508, 510, 451, 448, 453, 464; 236/46 R, 46 F, 46 D

[56] References Cited

U.S. PATENT DOCUMENTS 4,044,348 8/1977 Huebscher ..... 219/453
4,188,528 2/1980 Wierzchowski et al. ..... 219/492
4,214,151 7/1980 Kicherer et al. ..... 219/492

FOREIGN PATENT DOCUMENTS 19276 11/1980 European Pat. Off. ..... 219/492
2030799 4/1980 United Kingdom ..... 219/492

*Primary Examiner*—M. H. Paschall
*Attorney, Agent, or Firm*—Browdy and Neimark

[57] ABSTRACT

An energy regulator for a household heating appliance such as an electric cooker comprises an electronic controller for the cyclical control of the supply of electrical energy to a heating element and a switch for increasing the electrical energy supplied to the heating element to a preselected level and for a preselected time. The preselected time may be variable in dependence on the duty cycle of the controller, the duration decreasing from about thirteen minutes at low duty cycle to one minute or less at high duty cycle. Actuation of the switch may cause the electrical energy to be increased to substantially 30% of full heating power at low duty cycle rising to substantially 100% of full heating power at high duty cycle.

13 Claims, 3 Drawing Figures

ENERGY REGULATOR FOR A HOUSEHOLD HEATING APPLIANCE FOR PRODUCING VARIABLE SPEED INITIAL HEATING

BACKGROUND OF THE INVENTION

The present invention relates to an energy regulator for a household heating appliance such as an electrical cooker plate or an electrical oven.

DESCRIPTION OF PRIOR ART

There are known energy regulators for controlling the energy fed to an electrical cooker plate and which incorporate means for boosting the energy level temporarily. In the case of one such energy regulator, the energy level is boosted by a factor of about five for a fixed period of about nine minutes, but only at lower settings of the regulator control knob, and in the case of another such energy regulator the energy level is boosted to full power for a period which depends on the setting of the energy regulator control knob, full power being supplied to the cooker plate for a longer period for lower settings of the control knob.

One aim of these known energy regulators is to replace the so-called "autocook" facility which is commonly provided on electric hob cookers. This facility is intended to allow the user to select a predetermined cooking temperature which will then be attained and maintained under control of the autocook sensor. However, one problem of autocook devices is that it takes a prolonged time for the cooking temperature to be attained because the autocook sensor cuts down the energy supplied to the heating element at an early stage during the heating process. The first of the above-mentioned known energy regulators attempts to simulate and improve on the autocook facility by providing a fixed time boost of about five times standard power and the reverting to the energy level determined by the setting of the control knob of the regulator. However, the additional energy is often not sufficient to attain simmering conditions at lower settings of the control knob, whereas the increased energy at higher settings often results in too much power being supplied to the heating elements. Moreover, with this known energy regulator it is not possible to cancel the boost, after it has been applied by pulling the control knob, without disturbing the original setting of the knob. In the case of the second above-mentioned known energy regulator, the autocook facility is simulated by providing a variable time boost at full power with the duration of the boost being longer at lower settings of the control knob. This technique may provide a reasonable solution to the problem of attaining and maintaining simmering conditions, but at lower settings of the control knob the power supplied during the boost may be too great if, for example, a pan of boiling water has been topped-up with cold water or if cold food to be cooked has been placed in a pan of boiling water. Once again, it is not possible to cancel the boost after it has been applied, by pushing a control button on the control knob, without disturbing the original setting of the knob.

The above-mentioned known energy regulators also encounter a number of other problems. For example, they operate thermally, that is they have a heating resistor and a bi-metal switch connected in series with the load to be regulated. Although the power can be controlled steplessly with these known regulators, it is very difficult to set them to energy levels of less than 10 per cent of maximum. Moreover, it is difficult to mass-produce such regulators all having the same characteristics. These problems result in difficulties when such energy regulators are used in conjunction with electric cooker plates which are typically rated at 1500 to 2000 watts or more, because only low energy levels are required for simmering (about 100 watts) and for warming (about 40 watts).

OBJECT OF THE INVENTION

It is therefore an object of the present invention to provide an energy regulator which better simulates the autocook facility. It is a further object of the present invention to provide an energy regulator which provides better control over the heat output of the cooker plate than known regulators.

SUMMARY OF THE INVENTION

According to the present invention there is provided an energy regulator for a household heating appliance comprising:

control means for the cyclical control of the supply of electrical energy to a heating element; and a switch for increasing the electrical energy supplied to the heating element to a preselected level and for a preselected time.

The expression "duty cycle" is used herein to denote the proportion of a given period of time for which the control means is supplying electrical energy to the heating element. Thus, "low duty cycle" means that electrical energy is supplied to the heating element for a relatively small proportion of a given period of time and "high duty cycle" means that electrical energy is supplied to the heating element for a relatively high proportion of a given period of time.

Preferably, the preselected time is variable in dependence on the duty cycle of the control means, the duration of the preselected time decreasing as the duty cycle of the control means increases. The preselected time may be substantially thirteen minutes at low duty cycle decreasing to one minute or less at high duty cycle.

Actuation of the switch may cause the electrical energy to be increased to substantially 30% of full heating power at low duty cycle of the control means, increasing to substantially 100% of full heating power at high duty cycle.

The switch may comprise an actuating member in the form of a push-button disposed within a rotatable control knob for determining the duty cycle.

The control means preferably comprises an electronic controller which produces a triggering pulse for triggering a transistor, the transistor in turn causing a relay to operate to supply electrical energy to the heating element, the duration of the triggering pulse determining the duty cycle of the regulator.

The control means may include warning means for indicating when a cooking surface heated by said heating element is above a safe touching temperature. Preferably the warning means includes a timer which actuates a warning light a predetermined time after the energy regulator is switched on and which extinguishes the warning light a predetermined time after the energy regulator is switched off. The warning light may be switched on substantially 20 seconds after the energy regulator is switched on and the light may be extinguished substantially 45 minutes after the energy regulator is switched off. Alternatively, the warning means may include means for measuring the amount of energy dissipated by the heating element between switching on and switching off the regulator and for switching on a warning light for a time dependent upon the amount of energy dissipated.

The control means and the switch may be constructed to regulate more than one heating element. Preferably the regulation of more than one heating element is achieved by incorporating into the regulator a set of contacts which are maintained open if a rotatable control knob of the regulator is rotated in a first direction so as to energise only a single heating element and which are closed if the rotatable control knob is rotated in a second, opposite direction so as to energise said more than one heating element.

The control means may include a low voltage source for supplying to the contacts of a temperature limiter associated with the heating element such that if the temperature limiter detects an excessive temperature the contacts are opened and the heating element is de-energised.

For a better understanding of the present invention and to show more clearly how it may be carried into effect reference will now be made, by way of example, to the accompanying drawings in which:

DESCRIPTION OF PREFERRED EMBODIMENT

Figure 1:
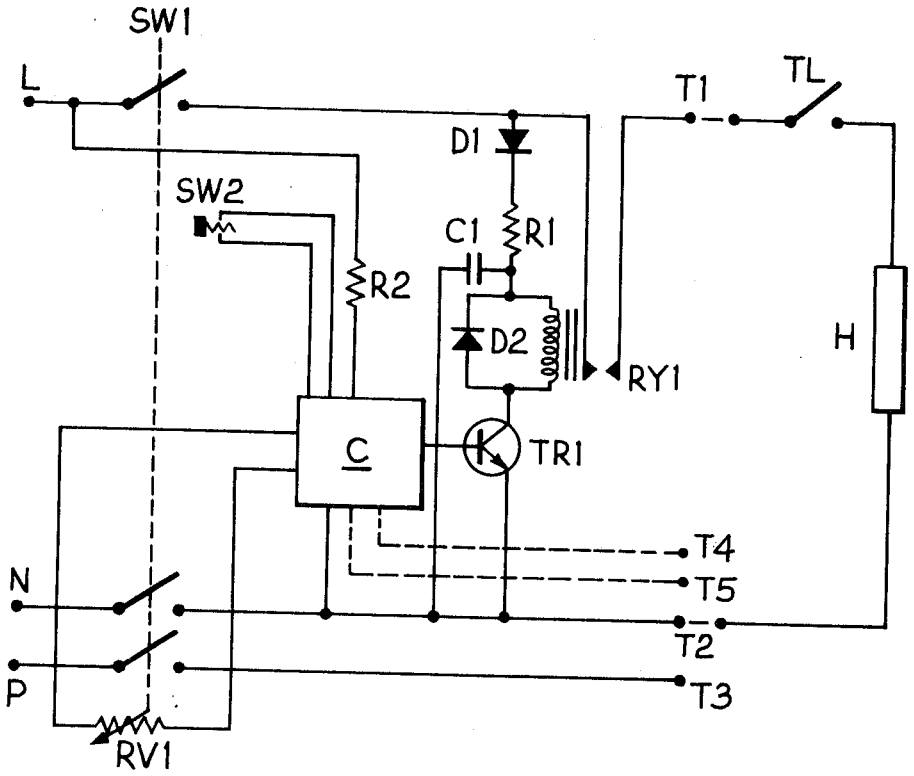
FIG. 1 is a diagrammatic circuit diagram of one embodiment of an energy regulator according to the present invention.

FIG. 1 shows a heating element H, for example a heating element of a radiant heater for a glass ceramic top cooker, having a temperature limiter TL connected in series therewith to protest against overheating. The limiter TL is connected to a terminal T1 of an energy regulator and the heating element H is connected to a terminal T2 of the regulator.

The energy regulator includes an on-off switch SW1 connected in the live (L) and neutral (N) power supply lines and, as shown in FIG. 1, also switches a pilot light power supply P which can be used to show that the energy regulator has been switched on by connecting a pilot light to terminal T3 and therefore to show that power is being supplied to a respective heater of the cooker. The on-off switch is also mechanically connected to a variable resistor RV1 which will be described in more detail hereinafter.

Electrical power from the live line L is fed via switch SW1 to one contact of relay RY1, the other contact of which is connected to terminal T1. Relay RY1 has normally open contacts and is actuated to close the contacts by a coil which is supplied with electrical energy from the live line by way of a rectifying diode D1 and a current limiting resistor R1. A further diode D2 is connected in parallel with the relay coil to eliminate back EMF and a smoothing capacitor C1 is connected between a point between resistor R1 and diode D2 and the neutral line N. The relay coil is connected to the neutral line N by way of a transistor TR1 which controls the relay as will be described in more detail hereinafter. Connected to the live line L, by way of a further current limiting resistor R2, is a controller C for controlling the operation of the transistor TR1 and other functions of the energy regulator.

The operation of the controller C is governed by the setting of the variable resistor RV1, which itself is determined by the position of the energy regulator control knob, and by a push-button switch SW2 which actuates the boost. Switch SW2 may be incorporated for example in the centre of the control knob, or if desired it may be a separate switch. The controller C also includes provisions for cancelling the boost, for example if it has been actuated inadvertently or if in any particular instance the user should find that the duration of the boost is too long. The boost may be cancelled by pushing the boost switch SW2 a second time or, if desired, a separate boost cancel switch may be provided. When the boost switch has been actuated, an electrical signal is sent to terminal T4 for connection to a boost warning light if desired.

The controller C may be constructed in a number of ways. For example, it may be made largely of discrete electrical components, using commercially available integrated circuits where possible. However, it is preferred to use as small a number of discrete components as possible and for this purpose it is desirable to use a custom-made integrated circuit.

The conroller C of the energy regulator may also incorporate a warning light actuator for indicating when the cooking surface is above a safe touching temperature of 50° to 60° C. For this purpose a warning light may be connected to terminal T5 and is actuated at predetermined time after the energy regulator is switched on, for example about 20 seconds, and remains actuated for a predetermined time after the energy regulator is switched off, for example 45 minutes. Alternatively, the time for which the warning light remains actuated may be determined by the amount of energy which has been dissipated by the heater.

The energy regulator may also be adapted for use with heaters having more than one heating element, for example so-called oval or concentric heaters. For this purpose, the regulator may incorporate an additional set of contacts which are designed to remain open if, say, the control knob is turned from the "off" position in a clockwise direction and to close, thereby energising an additional heating element, if the control knob is turned from the "off" position in an anticlockwise direction.

By incorporating additional functions into the energy regulator itself instead of providing separate accessories to achieve the same results, it is possible to simplify the construction and assembly of a cooking appliance and to improve the internal arrangement of components and wiring. Where separate accessories are employed, the use of such accessories inevitably complicates the construction and assembly of the appliance.

The operation of the energy regulator will be described with particular reference to FIG. 2. However, it will be appreciated that the characteristics of the energy regulator according to the present invention are not fixed and may be varied from those shown in FIG. 2 if desired.

Figure 2:
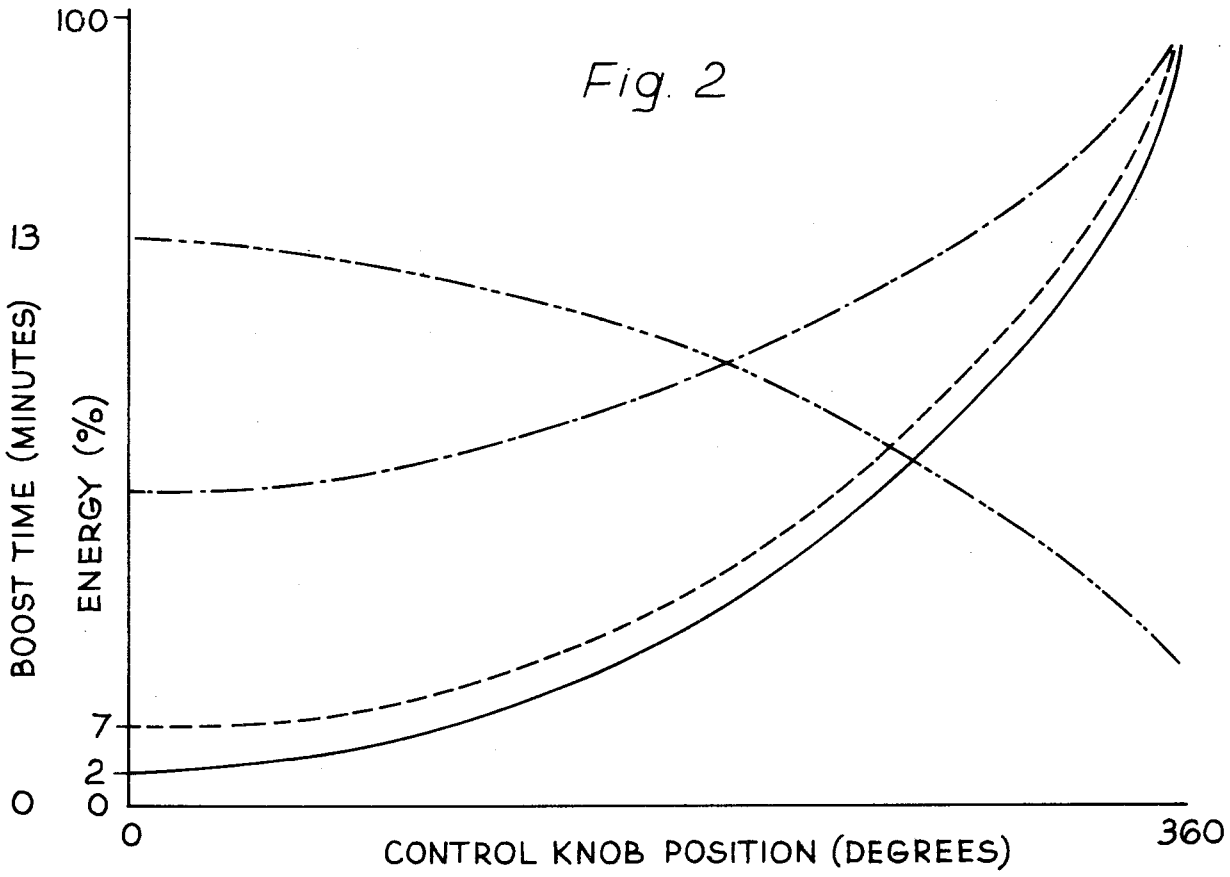
FIG. 2 is a graph showing one possible relationship between the boost time and the boost level with the setting of the energy regulator control knob.

The characteristics of the energy regulator according to the present invention under normal conditions are represented by the solid line in FIG. 2.

As the control knob is rotated, the resistance of the variable resistor RV1 is altered, which causes the controller C to increase the duty cycle of the regulator by increasing the time for which the transistor TR1 if triggered during each cycle, thereby energising the relay coil for progressively longer periods. With full rotation of the control knob, substantially 100% of maximum energy is delivered to the heating element H. The shape of the characteristic curve is chosen to give high levels of energy for correspondingly high degrees of rotation of the control knob, but to give a wide range of controllability for relatively low degrees of rotation of the control knob. For this purpose, the characteristic curve is relatively flat at low degrees of rotation but is relatively steep at high degrees of rotation. The particular characteristic curve illustrated shows a minimum energy level of 2%, but it will be appreciated that because the energy level is determined by the duration of the triggering pulse for the transistor TR1 the minimum energy level can be set at whatever value is desired and may be as low as 1% or less. Moreover, the duration of the triggering pulse is not directly dependent on the resistance of the variable resistor RV1, but may be determined by the controller C in response to the resistance of the variable resistor to give a wide variety of characteristic curves. Nonetheless, a minimum energy level of 2% compares very favourable with other energy regulators that are currently available, the best of which is illustrated by the dashed line in FIG. 2. It will be seen that this known, commercially available energy regulator has a minimum energy level of 7% which for a 2000 watt heater corresponds to a minimum heat output of 140 watts, whereas as mentioned above a minimum heat output of 40 watts (or 2% of 2000 watts) is desirable. It must also be pointed out that the energy regulator according to the present invention has particularly good reproducibility when mass-produced because of the inbuilt programming of the controller C which ensures that all such energy regulators have the same characteristic curve and the same minimum energy level. Conventional energy regulators, on the other hand, do not have a good reproducibility when mass-produced and both the shape of the characteristic curve and the minimum energy level vary considerably from what is considered to be the optimum for any particular regulator.

When the boost switch is actuated, the energy level no longer follows the solid line curve, but instead follows the dot-dash line curve with the energy level starting at about 30% for low degrees of rotation of the control knob and increasing progressively towards 100% for higher degrees of rotation of the control knob. It should be noted that the energy level during boost need not start at 30%, but may be varied depending upon the value that is found to be most suitable for any particular application. Moreover, the duration of the boost is also variable and follows the double-dot-dash line curve, giving a boost time of about 13 minutes at low degrees of rotation of the control knob decreasing to about one minute or even no boost at all at high degrees of rotation of the control knob.

Figure 3:
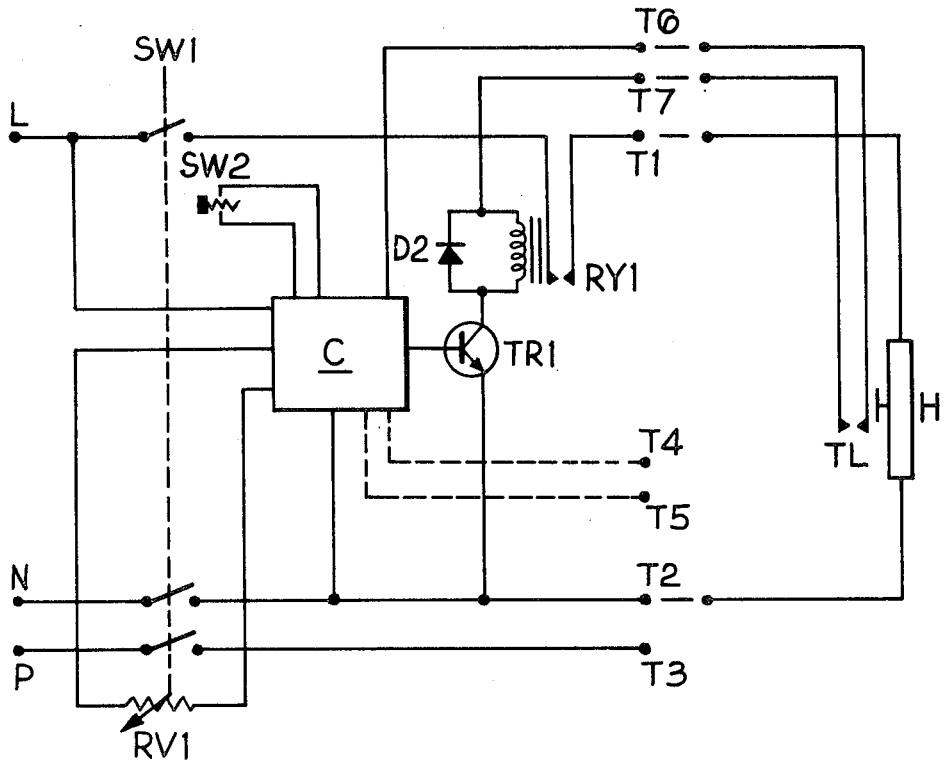
FIG. 3 is a diagrammatic circuit diagram of a second embodiment of an energy regulator according to the present invention.

FIG. 3 shows a further embodiment of an energy regulator according to the present invention. Where possible, the same references as those used in FIG. 1 are used in FIG. 3 to denote the same or similar parts.

As shown in FIG. 3, electrical power is fed directly to the controller C from the live line L. A low voltage direct current or alternating current of, say, 12 volts is produced within the controller and is fed to a terminal T6. Connected to the terminal T6 is one contact of the temperature limiter TL, while the other contact of the temperature limiter is connected to a terminal T7 which is in turn connected to the coil of relay RY1. Thus, if the temperature limiter detects an excessive temperature in the heater H the contacts of the limiter are opened and the relay coil is de-energised thus causing the contacts of the relay RY1 to open thereby de-energising the heater until such time as the limiter contacts close once more.

The lower voltage applied to the limiter contacts can eliminate RF1 (radio frequency interference) and extend the life of the contacts due to the elimination of arcing. It is also possible to use less expensive contacts in the limiter.

In both the embodiments shown in FIG. 1 and in FIG. 3, the energisation of the relay coil is controlled by a transistor TR1. The transistor may be replaced by any other suitable element such as a thyristor or triac. Further, it is also possible to eliminate the relay RY1 and to replace it with a triac.

I claim:

1. A household heating appliance comprising:
a heating element; and
an energy regulator which comprises:
control means for cyclical control of a supply of electrical energy to the heating element,
switch means associated with the control means such that when the switch means is actuated the electrical energy supplied to the heating element is increased to a predetermined level and for a predetermined time,
means included in the control means to cause said predetermined energy level to vary in accordance with the setting of said heating appliance chosen by the user, and
means included in the control means for varying the predetermined time in an inversely proportional manner to the variable energy level such that the duration of the predetermined time decreases automatically as the variable energy level increases.

2. A household heating appliance according to claim 1, wherein the predetermined time is substantially thirteen minutes at low duty cycle decreasing to a time not greater than one minute at high duty cycle.

3. A household heating appliance according the claim 1, wherein the control means includes means which, on actuation of the switch, causes the electrical energy to be increased to substantially 30 percent of full heating power at low duty cycle of the control means, increasing to substantially 100 percent of full heating power at high duty cycle.

4. A household heating appliance according to claim 1, wherein the switch means comprises an actuating member in the form of a push-button disposed within a rotatable control knob for determining the duty cycle.

5. A household heating appliance according to claim 1, wherein the control means includes means connected with the switch means such that actuation of the switch means subsequent to increasing the electrical energy to said predetermined level returns the supply of electrical energy to its original duty cycle.

6. A household heating appliance according to claim 1, wherein the control means comprises an electronic controller which produces a triggering pulse for triggering a transistor, the transistor in turn causing a relay to operate to supply electrical energy to the heating element, the duration of the triggering pulse determining the duty cycle of the energy regulator.

7. A household heating appliance according to claim 1, wherein the control means includes warning means for indicating when said cooking surface heated by said heating element is above said safe touching temperature.

8. A household heating appliance according to claim 7, wherein the warning means includes timing means which actuates a warning light a predetermined time after the energy regulator is switched on and which extinguishes the warning light a predetermined time after the energy regulator is switched off.

9. A household heating appliance according to claim 8, wherein the warning light is switched on substantially 20 seconds after the energy regulator is switched on and the warning light is switched off substantially 45 minutes after the energy regulator is switched off.

10. A household heating appliance according to claim 7, wherein the warning means includes means for measuring the amount of energy dissipated by the heating element between switching on and switching off the regulator and means for switching on a warning light for a time dependent upon the amount of energy dissipated.

11. A household heating appliance according to claim 1, wherein the control means and the switch means are constructed to regulate more than one heating element.

12. A household heating appliance according to claim 1, wherein the regulation of more than one heating element is achieved by incorporating into the regulator a set of contacts which are maintained open if a rotatable control knob of the regulator is rotated in a first direction so as to energise only a single heating element and which are closed if the rotatable control knob is rotated in a second opposite direction so as to energize said more than one heating element.

13. A household heating appliance according to claim 1, wherein the control means includes a low voltage source for supplying electrical energy to the contacts of a temperature limiter associated with the heating element such that if the temperature limiter detects an excessive temperature the contacts are opened and the heating element is de-energised.

* * * * *